US006700981B1

(12) United States Patent
Howard

(10) Patent No.: US 6,700,981 B1
(45) Date of Patent: Mar. 2, 2004

(54) DUAL INPUT HEADPHONE APPARATUS

(76) Inventor: Ben Howard, 43 Orchard St., Teaneck, NJ (US) 07666

( * ) Notice: Subject to any disclaimer, the term of this patent is extended or adjusted under 35 U.S.C. 154(b) by 0 days.

(21) Appl. No.: 09/273,614

(22) Filed: Mar. 22, 1999

(51) Int. Cl.[7] ..... H04R 1/10
(52) U.S. Cl. ..... 381/74; 381/384; 381/309
(58) Field of Search ..... 381/74, 72, 309, 381/370, 384

(56) References Cited

U.S. PATENT DOCUMENTS 4,621,372 A * 11/1986 Relyea ..... 381/74
4,829,571 A * 5/1989 Kakiuchi et al. ..... 381/309
4,944,016 A * 7/1990 Christian ..... 381/74

* cited by examiner

*Primary Examiner*—Ping Lee
(74) *Attorney, Agent, or Firm*—Arthur I. Degenholtz

(57) ABSTRACT

A headphone unit having left and right ear piece units and an input cord having two conductors an end of each of which projects into a housing. Within the housing, the input cord is connected to two equipment cords which terminate in a pair of input plugs. Each of the equipment cords has two lines. The input plugs each have portions for receiving left and right audio signals. The lines carrying left audio signals from the two input plugs are connected to the input cord conductor which leads to the left ear piece unit and the lines carrying right audio signals from the two input plugs is connected to the input cord conductor which leads to the right ear piece unit.

7 Claims, 3 Drawing Sheets

DUAL INPUT HEADPHONE APPARATUS

FIELD OF THE INVENTION

The present invention relates generally to the field of audio headphones and more particularly to a dual input headphone apparatus.

BACKGROUND OF THE INVENTION

The prior art related to headphones includes the following US Patent.

U.S. Pat. No. 4,829,571 to Kakiuchi, et al. shows a stereo headphone set which is connected to an input plug and which includes a mutina switch located on an intermediate portion of the headphone cord to allow muting of the input signal. The muting switch disconnects the headphone set from an audio source and allows the user to listen to surrounding sounds.

Despite the various developments in the prior art, there remains a need for a dual input headphone apparatus which can enable a user to receive simultaneous audio signal inputs from two different audio sources.

OBJECTS AND SUMMARY OF THE INVENTION

It is an object of the present invention to provide a dual input headphone apparatus which enables a user to practice playing an electronic musical instrument while listening to musical accompaniment without disturbing others in the surrounding area.

Another object of the present invention is to provide a dual input headphone apparatus which facilitates a user learning to play an electronic musical instrument by enabling the user to listen to listen to his or her musical instrument while also listening to audio instruction.

Another object of the present invention is to provide a dual input headphone apparatus which enables a user to practice playing an electronic musical instrument while reducing associated tedium.

Another object of the present invention is to provide a dual input headphone apparatus which enables a user to practice playing an electronic musical instrument without disturbing others.

Another object of the present invention is to provide a dual input headphone apparatus which enables a user to practice playing an electronic musical instrument while listening to other musicians or vocalists.

Another object of the present invention is to provide a dual input headphone apparatus which does not interfere with a user playing an electronic musical instrument.

Yet another object of the present invention is to provide a dual input headphone apparatus which comprises a relatively small number of component parts which can be manufactured economically in volume resulting in a relatively low overall cost.

The foregoing and other objects and advantages of the invention will appear more clearly hereinafter.

In accordance with the present invention there is provided a dual input headphone apparatus which includes a headphone unit having left and right ear piece units and an input cord having two conductors. An end of the input cord projects into a housing. Within the housing, the input cord is connected to a pair of equipment cords each of which is connected to an input plug. Each of the equipment cords has two lines. The input plugs have input portions for receiving left hand and right hand audio signals. The lines carrying left hand audio signals from the input plugs are connected to the input cord conductor which leads to the left ear piece unit and the lines carrying right hand audio signals from the two plugs are connected to the input line conductor which leads to the right ear piece unit.

DESCRIPTION OF THE DRAWINGS

Other important objects and advantages of the invention will be apparent from the following detailed description of the invention taken in connection with the accompanying drawings in which.

DETAILED DESCRIPTION OF THE INVENTION

Figure 1:
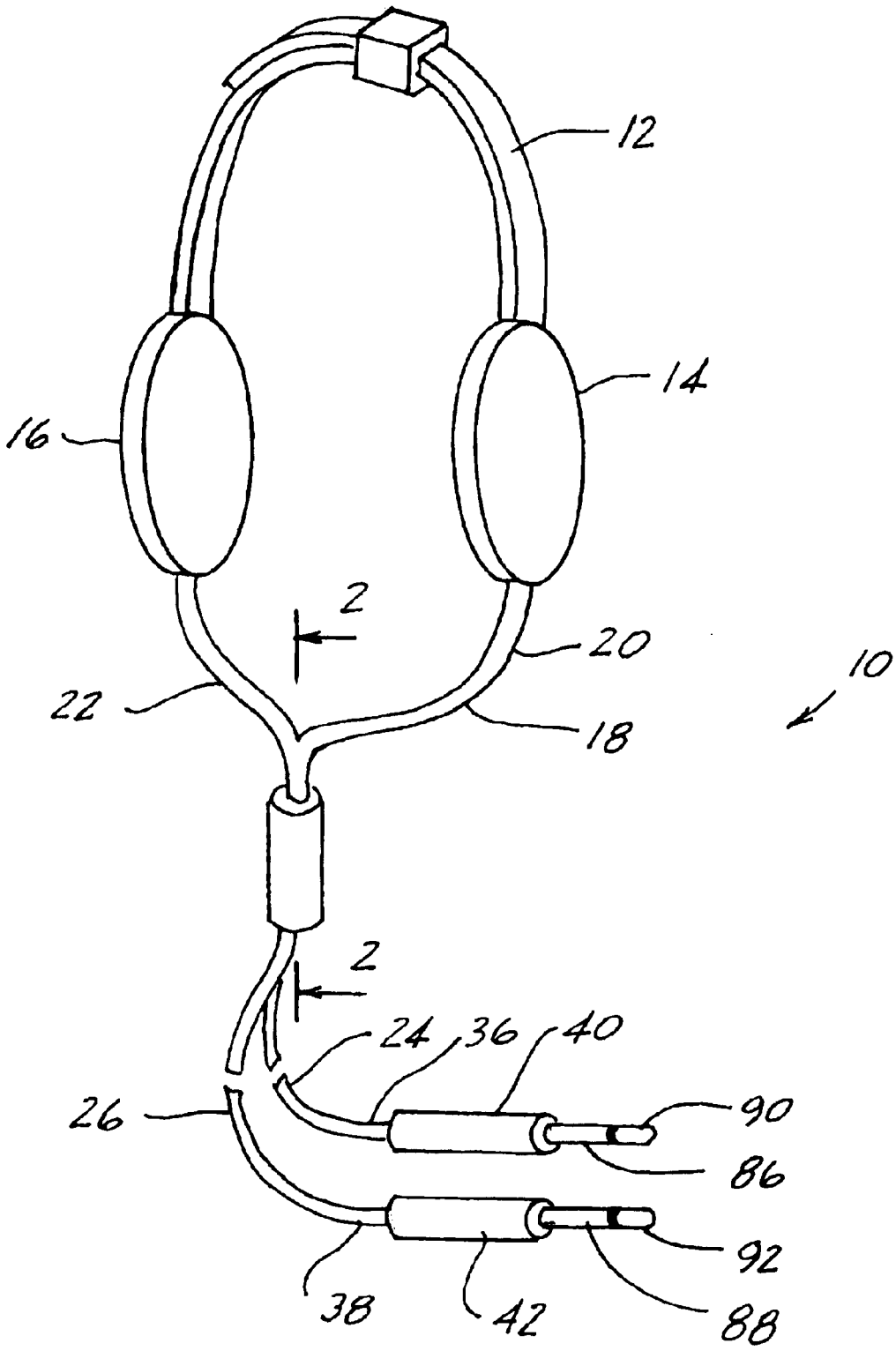
FIG. 1 is an overall perspective view of a dual input headphone apparatus, made according to the present invention.

With reference to the drawings, in which like reference numbers designate like or corresponding parts throughout, there is shown in FIG. 1 a dual input headphone apparatus, generally designated by reference number 10, made in accordance with the present invention, which includes a headphone unit 12, having left and right ear piece units 14,16, an input cord 18, which has two lines 20,22 which carry left audio signals and right audio signals, respectively, and a pair of equipment cords 24,26. Each of the equipment cords 24,26 has two lines 28,30 and 32,34 which carry left audio signals and right audio signals, respectively. The first end 36,38 of each of the equipment cords 24,26 is connected to an input plug 40,42. As is best shown in FIG. 2, the second ends 44,46 of the equipment cords 24,26 are connected to the lines 20,22 of the input cord 18 in a manner which will be presently described.

The equipment cords 24,26 and the input cord 18 enter the housing 48 via apertures 50,52 which are formed in the upper end 54 and the lower end 56 of the housing 48, respectively. The housing 48 is generally cylindrical and includes an outer shell 58 and an inner shell 60. The outer shell 58 fits closely over the inner shell 60 and the inner and outer shells 58,60 may be joined by the application of a bead of adhesive 62 in the area indicated by the reference number 64. The housing 48 is elongated in configuration and has a diameter which is only slightly greater than the diameter of the input cord 18 and the equipment cords 24,26 thereby resulting in a structure which does not add any appreciable bulk to the input cord 18 and the equipment cords 24,26 and does not interfere with the normal playing of a musical instrument. The housing 48 may be proportioned to provide space in the areas designated by the reference numerals 66,68 to accommodate a knot indicated schematically by the broken lines 70,72 being tied in the input cord 18 and in the equipment cords 24,26 for the purpose of preventing forces in the directions shown by the arrows 74,76 from pulling the input cord 18 and the equipment cords 24,26 out of the housing 48.

Figure 2:
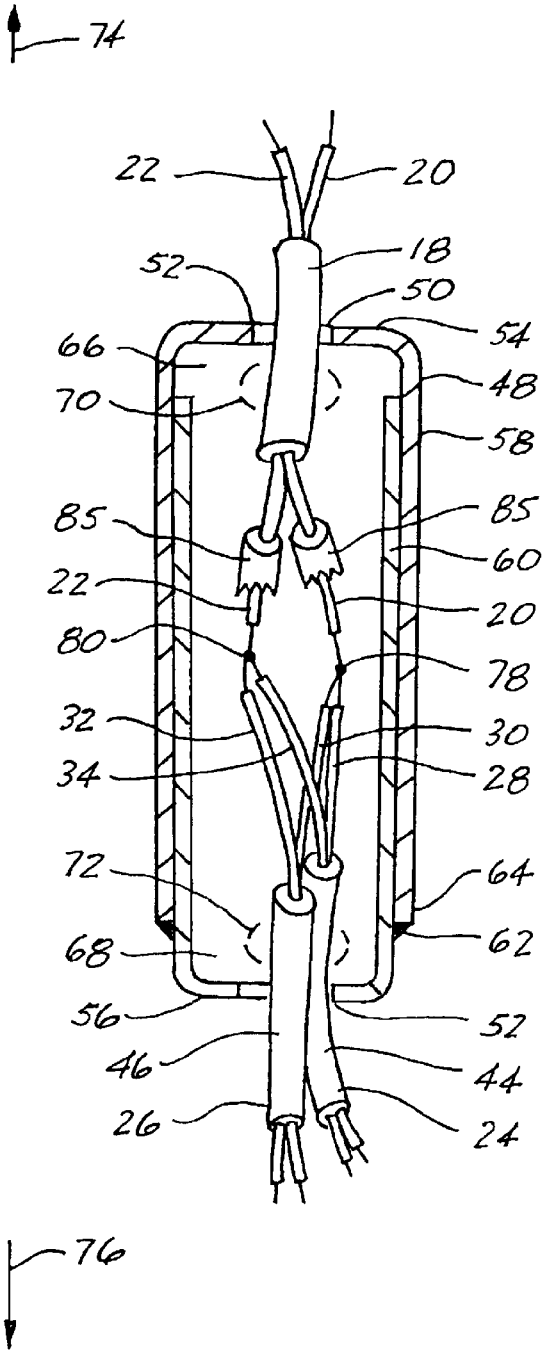
FIG. 2 is a cross-sectional view taken along the line 2—2 of FIG. 1.
Figure 3:
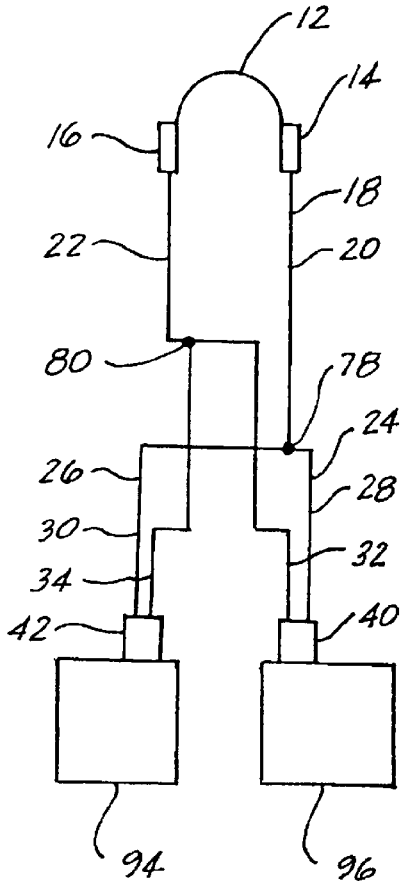
FIG. 3 is a schematic view of the dual input headphone apparatus, showing the apparatus in use connected to an electronic musical instrument amplifier and also to a stereo amplifier.

As is shown in FIGS. 2 and 3, the equipment cord 24,26 lines 28,30 which carry left audio signals are connected to the input line 20 which carries left audio signals to the ear piece unit 16 and similarly, the equipment cord lines 32,34 which carry right audio signals are connected to the input line 22 which carries right audio signals to the ear piece unit 14. The electrical connections connecting the lines 20,28,30 and 22,32,34 indicated by the reference numbers 78,80 may by accomplished by soldering, crimping or any other process which results in a reliable electrical connection. The electrical connections 82,84 are covered by insulating sleeves 85 or insulating tape.

The input plugs 40, 42 each have portions 86,88 which receive left audio signals and portions 90,92 which receive right audio signals. The lines 28,30 are connected to the portions 86, 88 and the lines 32,34 are connected to the portions 90,92.

As is shown in FIG. 3, during use the user is able to receive audio signals from the musical instrument amplifier 94 as well as the stereo amplifier 96. The user is thus able to hear his or her musical performance without disturbing others while simultaneously hearing music or instructional material from the stereo amplifier 96.

Figure 4:
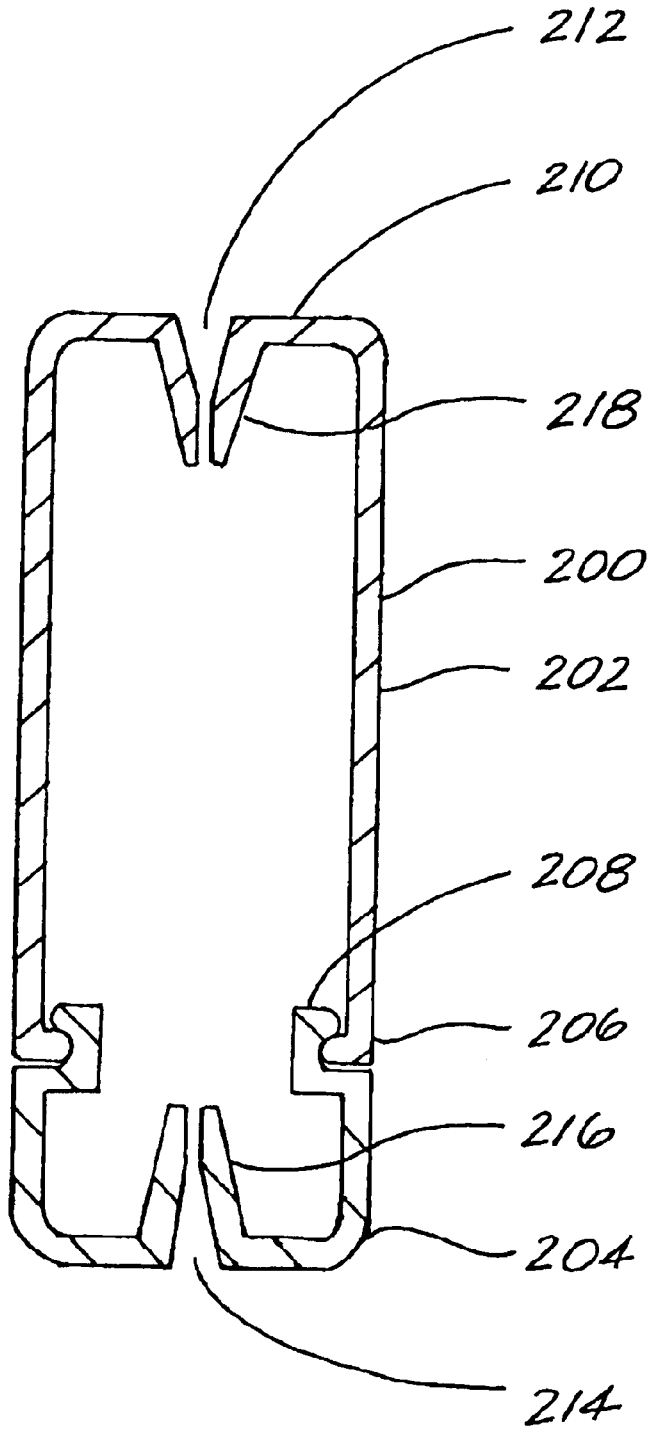
FIG. 4 is a cross-sectional view, similar to FIG. 3, showing an alternative embodiment of the housing of FIG. 2.

FIG. 4 shows an alternate version of the housing 200 which includes a upper shell 202 and a lower shell 204 which are joined together by interlocking snap-fit portions 206,208. The end 210 of the upper shell 202 has an aperture 212 for the introduction of the input cord 18 and the lower shell 204 has an aperture 214 for the introduction of the equipment cords 24,26.

Adjacent to the apertures 212,214 there are integrally formed inwardly directed flexible collars 216,218 which are displaced, or deflected outwardly by the introduction of the input cord 18 and the equipment cords 24,26. The collars 216,218 are proportioned to grip the input cord 18 and the equipment cords 24,26 tightly and resist the removal of the input cord 18 and the equipment cords 24,26 from the housing 200. The housing 200 thus retains the input cord 18 and the equipment cords 24,26 and prevents stress from being applied to the electrical connections 78,80 during handling and use.

The foregoing specific embodiment of the present invention as set forth in the specification herein is for illustrative purposes only. Various deviations and modifications may be made within the spirit and scope of this invention without departing from the main theme thereof.

What is claimed is:

1. A dual input headphone apparatus comprising:

a headphone set having a left ear piece unit and a right ear piece unit;

a first input line cord having a first end and a second end with said first end of said first input line cord electrically connected to said left ear piece unit;

a second input line cord having a first end and a second end with said first end of said second input line cord electrically connected to said right ear piece unit;

a first equipment cord set having a first end and a second end and having a first equipment line and a second equipment line;

a second equipment cord set having a first end and a second end and having a third equipment line and a fourth equipment line;

a first input plug with said first input plug electrically connected to said first end of said first equipment cord set;

a second input plug with said second input plug electrically connected to said first end of said second equipment cord set;

with said first and said second input plugs each having input portions for receiving left and right audio signals;

with said input portion for receiving left audio signals on said first input plug connected to said first equipment line;

with said input portion for receiving right audio signals on said first input plug connected to said second equipment line;

with said input portion for receiving left audio signals on said second input plug connected to said third equipment line;

with said input portion for receiving right audio signals on said second input plug connected to said fourth equipment line;

a hollow housing having a pair of apertures for entrance of said second ends of said line cord and said second ends of said first and said second equipment cords sets;

electrical connection means disposed in said housing for connection of said second end of said first line cord and said second end of said first equipment line of said first equipment cord set and for connection of said second end of said third equipment line of said second equipment cord set and said second end of said first line cord, and electrical connection means disposed in said housing for connection of said second end of said second line cord and said second end of said second equipment line of said first equipment cord set and for connection of said second end of said fourth equipment line of said second equipment cord set and said second end of said second line cord.

2. The dual input headphone apparatus of claim 1 in which said housing is generally cylindrical.

3. The dual input headphone apparatus of claim 1 in which said electrical connection means comprises a solder connection.

4. The dual input headphone apparatus of claim 1 in which said electrical connection means comprises a crimp connection.

5. The dual input headphone apparatus of claim 1 in which said housing comprises:

an inner shell, and an outer shell.

6. The dual input headphone apparatus of claim 5 in which said housing further comprises:

a snap-fit portion formed on said inner shell, and a snap-fit portion formed on said outer shell, with said snap-fit portions disposed to join said inner shell and said outer shell.

7. The dual input headphone apparatus of claim 1 in which said aperture portions each comprise flexible collar portions proportioned to tightly fit said line cord and said equipment cord sets.

* * * * *